US008016288B1

(12) United States Patent
Guridi

(10) Patent No.: US 8,016,288 B1
(45) Date of Patent: Sep. 13, 2011

(54) TABLE GAME FOR EXERCISING AND FUN

(75) Inventor: Jose Javier Silva Guridi, Spring, TX (US)

(73) Assignee: Racket Power Inc., Spring, TX (US)

( * ) Notice: Subject to any disclaimer, the term of this patent is extended or adjusted under 35 U.S.C. 154(b) by 0 days.

(21) Appl. No.: 12/655,278

(22) Filed: Dec. 28, 2009

Related U.S. Application Data

(60) Provisional application No. 61/203,828, filed on Dec. 30, 2008.

(51) Int. Cl.
*A63F 7/00* (2006.01)

(52) U.S. Cl. ..... 273/119 R; 273/118 R; 273/129 R; 273/129 L; 273/129 W

(58) Field of Classification Search ..... 273/108, 273/118 R, 119 R, 129 R, 129 L, 129 V, 129 W
See application file for complete search history.

(56) References Cited

U.S. PATENT DOCUMENTS

| | | | | | |
|---|---|---|---|---|---|
| 1,606,826 | A | * | 11/1926 | Burger | 273/119 R |
| 2,627,412 | A | * | 2/1953 | Bronson | 273/108 |
| 2,960,339 | A | * | 11/1960 | Bush | 273/119 R |
| 5,516,102 | A | * | 5/1996 | Polk et al. | 273/119 R |
| 5,884,911 | A | * | 3/1999 | Guridi | 273/119 R |
| RE37,451 | E | * | 11/2001 | Guridi | 273/119 R |
| D476,697 | S | | 7/2003 | Guridi | |
| 2009/0085286 | A1 | * | 4/2009 | Grist et al. | 273/121 D |

OTHER PUBLICATIONS

"Defendant John S. Egbert and John S. Egbert D/B/A and OBO Harrison & Egbert's Motion for Summary Judgement", *USA, Inc. adn Totuma, Inc.* v. *John S. Egbert and John S. Egbert d/b/a and obo Harrison & Egbert*, District Court of Harris County, 80th Judicial District; Cause No. 2004-14655, Filed Aug. 5, 2005 (40 pages).
"Leading the way in leisure" Advertisement for CIRSA—International Amusement Manufacturing Company; Intergame Magazine, Mar. 2000 (1 page).
"Leading the way in leisure" Advertisement for CIRSA—International Amusement Manufacturing Company; Intergame Magazine, Jan. 2001 (1 page).
"Leading the way in leisure" Advertisement for CIRSA—International Amusement Manufacturing Company; Intergame Magazine, Nov. 2000 (1 page).
"World Cup Class! International Shoot-Out" Advertisement for Design Plus Industries; Replay Magazine, Apr. 2000, p. 41 (1 page).
"International Shoot-Out Soccer from Design Plus!", Advertisement for Design Plus Industries with Description; Replay Magazine, Apr. 2000, cover page and p. 10 (2 pages).

* cited by examiner

*Primary Examiner* — Raleigh W. Chiu
(74) *Attorney, Agent, or Firm* — Osha • Liang LLP

(57) ABSTRACT

A new and novel design and improvements of an existing table game with paddles and opposite players. These improvements provide for a significantly superior game in the areas of no jarring to the players, less manufacturing cost, prevention of damaging the game while is being played, easier assembly, packaging, shipping and handling. These innovations include side paddle openings, new two piece construction, new straight line apex of playing surface and new ball tray system. These new and significant improvements provide for the existing game to be manufactured at a fraction of the cost and weight while significantly improving playability.

7 Claims, 3 Drawing Sheets

TABLE GAME FOR EXERCISING AND FUN

This application relies upon U.S. Provisional Patent Application Serial No. U.S. 61/203,828 filed Dec. 30, 2008

FIELD OF THE INVENTION

This invention relates to Table Games.

BACKGROUND OF THE INVENTION

Those skilled in the art recognize the limitations of previous models of this type of table games since the paddles of the previous art had limited right and left movements, this resulted in continuous jarring of the player's arms.

Moreover, previous models of this type of table game easily sustained damage from the continuous pounding from the paddle assembly member against the side walls.

Moreover, the "no hitting the side walls" innovation herein presented prevents having to add hundreds of pounds of weight to the table game of the previous art to prevent it from substantial movement on the floor while in play due to the pounding from the paddle assembly member against the side walls.

Moreover, another substantial benefit of the lateral openings of the present invention, allows the paddles members to significantly protrude past the side walls. This benefit is that when the ball is at the side rail positions the hit from the paddle is not longer the predictable straight line shot of the previous art. The ability to protrude from the side rail allows different angles to be achieved for the return of the ball to the opponent. While playing the model of the previous art, players spent considerable amount of time "digging" out the ball from the side rail so their shots are not predictable.

Moreover, previous models of this table game were limited in the length of the playing area since they were constructed of one piece. This allowed the ball to be faster than the eye, limiting the art of playing the game.

Moreover, the ball racking system of previous art require racking of the balls one by one, which in a game of forty two points is extremely time consuming and tedious.

Moreover, the table game of the previous art describes a "parabolic fix incline apex" that slows down the ball return to the player after bouncing to the middle of the playing surface.

The new and novel design presented herein over the prior art consist of several new elements which bring substantial improvement to; the playability of the game, the no jarring of the players, manufacturing of the table game, the prevention of damaging the table game, the assembly of the table game and other miscellaneous such as shipping, packaging, lower cost and easier handling.

It is important to know that the models of the previous art consist of an awkward, difficult to play and to manufacture games.

SUMMARY OF THE INVENTION

The present invention provides for a new design of an existing table game with new and novel significant improvements.

Notably, this new and novel design has side walls openings for the paddle members to have the ability to travel pass the side walls.

Notably, a table game designed to be constructed in two halves, where they are assemble independently of each other and thereafter connected.

Notably, a table game built with a straight line fix incline, instead of the curved parabolic of the previous art.

Notably, a multiple ball racking system that allows players to start playing another game immediately after finishing one.

Notably, a table game that can be built longer than the previous art with hundreds of pounds of less weight.

DETAILED DESCRIPTION OF THE INVENTION

A table game with longitudinal openings about the sides of the paddle assembly area that permits the blades of the paddles to pass beyond the side walls of the table but do not allow the balls to escape. This is due to the diameter of the ball being of greater length than the width of the paddle blade. This innovation prevents the constant pounding of the side walls since allows the paddles to significantly travel beyond the side walls this would require a hard to perform lateral stretching of the arms of player. In addition, the player that does perform this lateral side reach to the end would be aligning the center goal opening with the side wall for an easy an counter productive score from his opponent.

Another model of the present invention shows a center "Rail" in the longitudinal slot of the side walls that also shows an alternative way of preventing the balls from escaping the table trough the side longitudinal openings. This center Rail requires the use of the dual blade design shown herein with a gap between them. This allows one blade to go over the longitudinal opening Rail and the other blade to go under. This dual blade paddle permits the two blades to hit the balls on two points of contact that are of equal distance from the center of the ball. This allows for the ball to be sent straight to the opponent without the adverse effects of pressing down or up on the balls.

A table game that is constructed in two separated halves so the several benefits described above can be achieve. The manufacture task is easier since the manufacturer builds two identical smaller tables that are easy to attach to each other once they reach the consumer.

The game of the previous and present model hit the balls making them travel at speeds of 50 miles per hour and more. The two halves construction allows now for tables to be built with twice the playing surface distance than before, at a fraction of the cost and in combination with the side longitudinal openings described above, at a fraction of the weight.

A table game that permits a very stream lined design consisting of two straight playing surfaces instead of the space taking curved traditional models. This new straight line model permits the side walls to be of significant low height, thus allowing the easier handling and lower manufacturing cost.

A table game with four "ball trays", two that can be removed after the game ends so the balls can be quickly dropped on the trays that are affixed to the sides of the table. The two now empty trays can be returned to the ball collecting goal area.

DESCRIPTION OF THE DRAWINGS

FIG. 1 Shows a perspective view of the entire table where the two halves have been connected together. The system of eight legs showing on this drawing of FIG. 1 is what allows the two halves to be assembled independently of each other. Another benefit of the eight leg system is that allows for a steady but lightest possible construction. Another benefit of the eight leg system is that allows for all the leg bracing being of the exact length for easy manufacturing, packaging and assembly.

FIG. 1*a* shows a removable tray where all the balls that have been played collect which allows the player to hang it with all the balls on the side of the table for the next game. The empty tray from the side replaces the filled up tray.

FIG. 2 Shows a closed up of the end paddle assembly. This view shows a new type of side to side moving bridge than the prior art. This new bridge assembly is more effective, easy to move laterally and provides the player with a much better view of the paddle playing area than the assembly of the previous models. FIG. 2*a* shows the lateral openings that allows the shoes of the paddle system to significantly slide past the side wall of the table. This opening does not allow the ball to go through since it is smaller than the diameter of the ball. Without these openings the mobility of the paddle system will be severely restricted to a few inches as shown in the prior art, which will required a tremendous and very expensive reinforcement of the table to prevent damage. The player with this new table of FIG. 2 no longer he decides since it would required naturally to the left or right. In addition the player that extends all the way is lighting up the center opening between the two shoes of the paddle system for a goal to be score which is the opposite to the intent of the game.

FIG. 2*b* shows a portion of the removable ball collecting tray.

FIG. 3 shows a lateral view of the two halves of the table assembled and ready to be booted together. It is to be noted a new and novel side rail system which consist of thin metal strips which allows seeing through the action. Also is a lot less heavy and used a lot less material that the solid rails of the previous art. FIG. 3*a* shows a rail that the ball hits at the center of the ball to prevent for the ball exiting in that area. This new rail in the middle of the opened laterals requires the new fork design of paddle of FIG. 4.

FIG. 4*a* shows the fork design that allows the shoes of the paddle to protrude pass the lateral opening without hitting the center rail. This happens by one of the end members of the fork passing under the rail and the other end member passing over the rail.

FIG. 5 shows a perspective view of an assemble side of the table. FIG. 5*a* shows a lateral rail that the customer assembles him self and FIG. 5*b* show an end rail that also is assemble by the customer. This modular manufacturing and assembly by the customer provides for significantly improve shipping in which very little air is shipped compared to the prior art.

Figure 1:
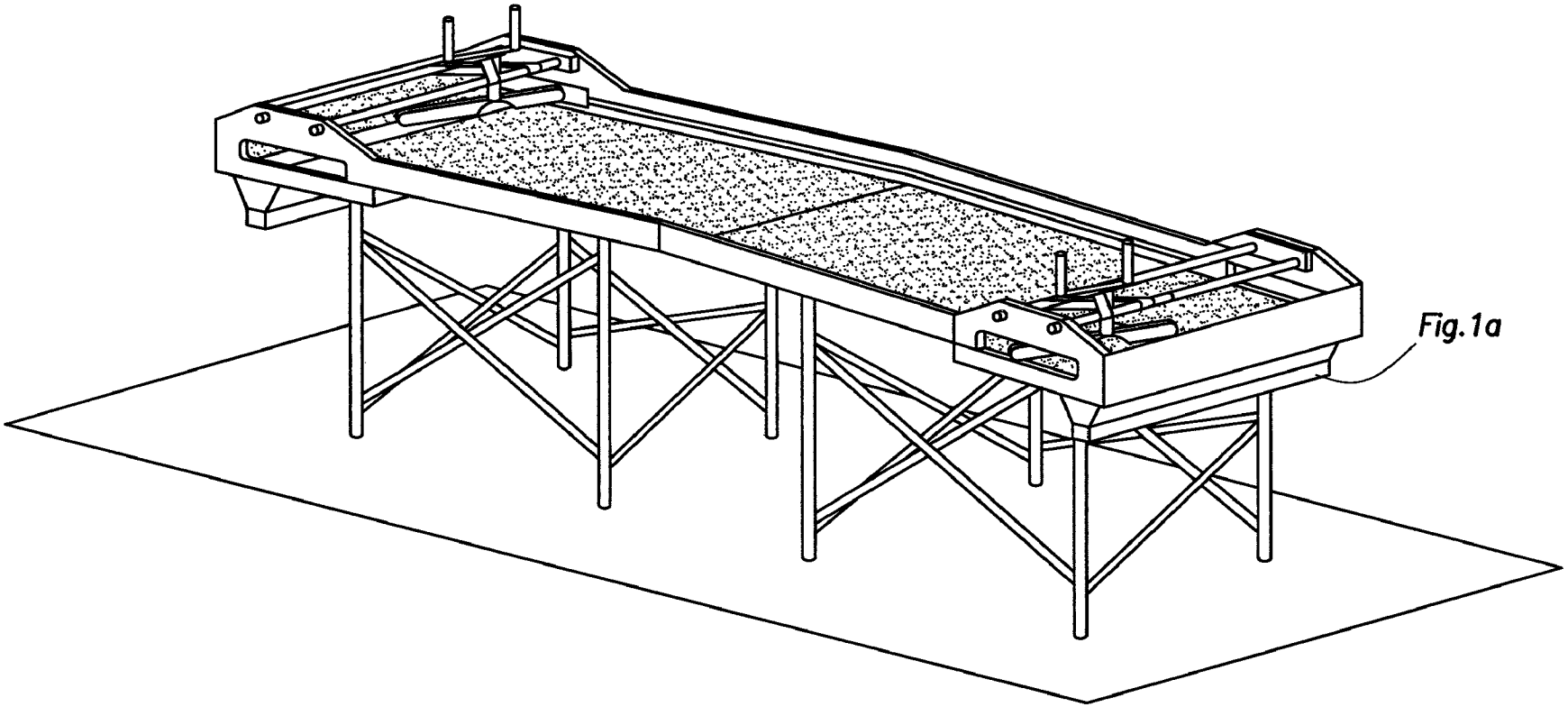
FIG. 1
Figure 2:
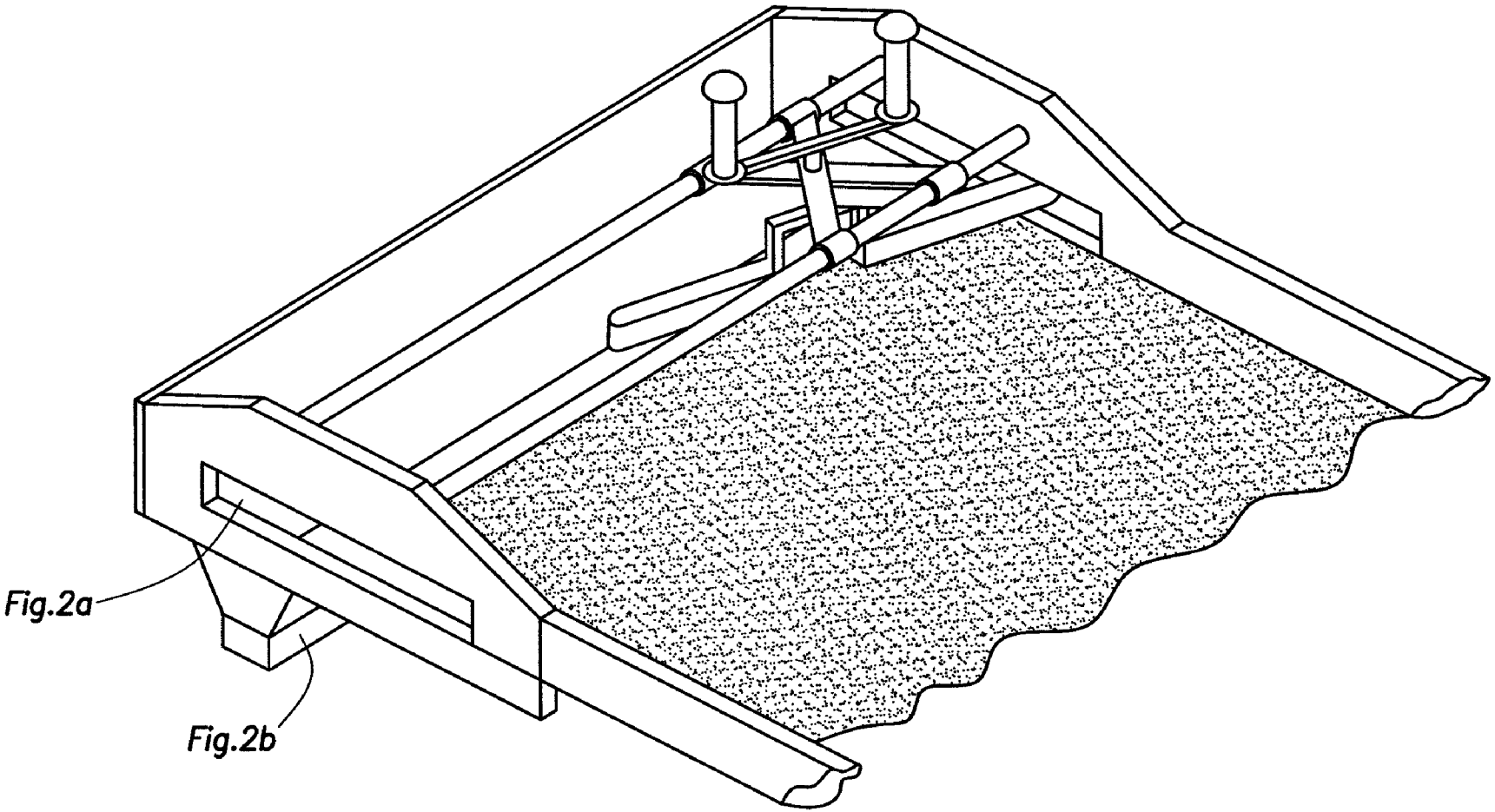
FIG. 2
Figure 3:
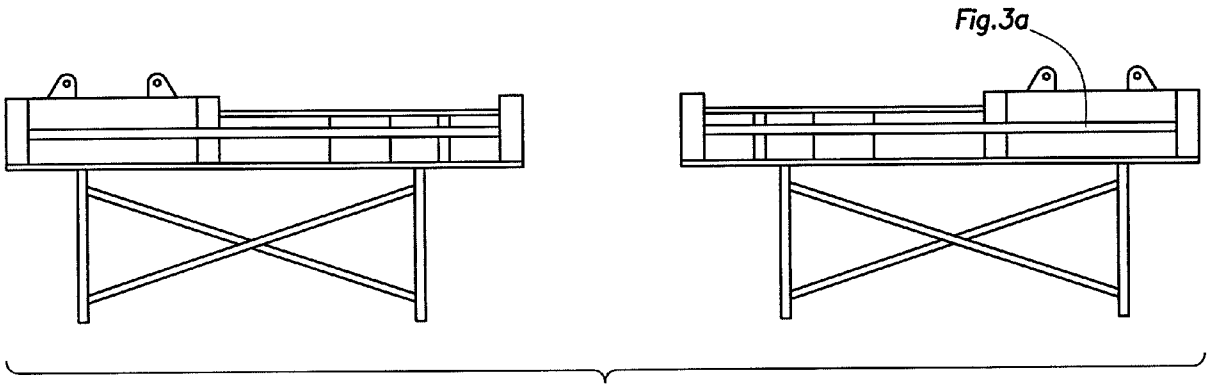
FIG. 3
Figure 5:
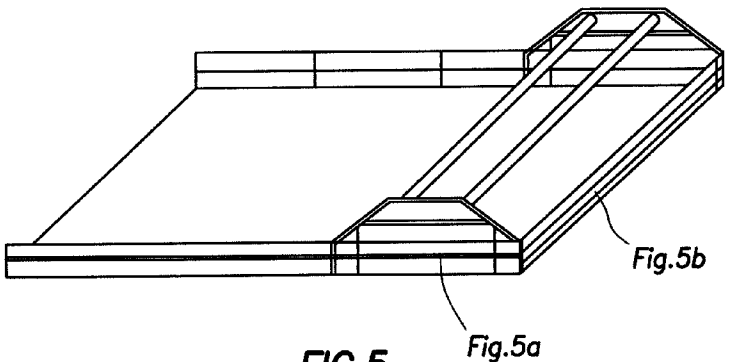
FIG. 5
Figure 4:
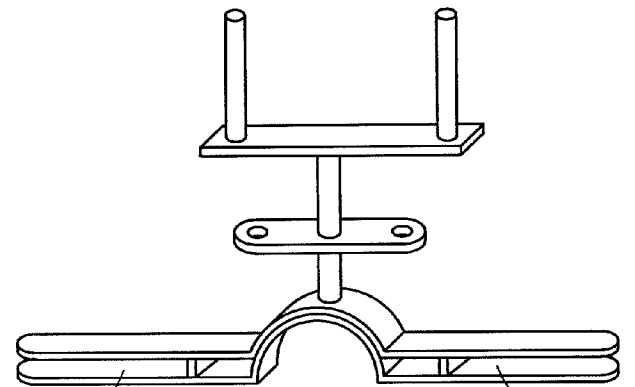
FIG. 4

What is claimed is:

1. A table game comprising:
- a housing;
- a playing surface received within said housing;
- handles disposed within the housing for controlling paddles of a paddle assembly member; and
- longitudinal openings contained in said housing for the purpose of allowing the paddles of the paddle assembly member to travel to a certain length outside the housing.

2. The table game of claim 1, constructed of two or more sections to facilitate transportation and assembly.

3. The table game of claim 1, wherein the playing surface is inclined.

4. A table game comprising:
- a housing;
- a playing surface received within said housing;
- a least one bar extending across the housing;
- a paddle assembly member, wherein the paddle assembly member comprises:
  - at least one paddle,
  - a first and a second vertical handle affixed to a crossbar and disposed within the housing for controlling the at least one paddle, and
  - a vertical member connected to the crossbar and the at least one bar, wherein the vertical member is rotatable and slidable relative to the at least one bar;
- longitudinal openings contained in said housing for the purpose of allowing the paddles of the paddle assembly member to travel to a certain length outside the housing.

5. The table game of claim 4, wherein the longitudinal openings include a center rail traversing the longitudinal opening and the paddles have a fork design to allow the paddles to travel the certain length outside the housing without contacting the center rail.

6. The table game of claim 4, wherein the table game is constructed of two or more sections to facilitate transportation and assembly.

7. The table game of claim 4, wherein the playing surface is inclined.

* * * * *